United States Patent [19]

Mekler

[11] 4,149,381

[45] Apr. 17, 1979

[54] SINGLE HAND OPERATED TOOL

[76] Inventor: Dan Mekler, 18 Methodela St., Jerusalem, Israel

[21] Appl. No.: 815,377

[22] Filed: Jul. 13, 1977

[51] Int. Cl.[2] ..... F15B 15/18

[52] U.S. Cl. ..... 60/477; 60/481; 60/DIG. 10; 30/180

[58] Field of Search ..... 30/180; 60/413, 477, 60/478, 479, 481, DIG. 10

[56] References Cited

U.S. PATENT DOCUMENTS

| | | | |
|---|---|---|---|
| 2,979,032 | 4/1961 | Engquist et al. | 60/481 X |
| 3,058,214 | 10/1962 | Mekler | 30/180 |

*Primary Examiner*—Edgar W. Geoghegan
*Attorney, Agent, or Firm*—Donald M. Sandler

[57] ABSTRACT

A single-hand operated tool comprising: first and second relatively movable elements adapted to be associated with a head assembly for application of pressure to a workpiece; a housing; a hydraulic pump disposed within the housing; hydraulic fluid communication means associated with the pump for exerting hydraulic force on the relatively movable elements; articulated lever means associated with the pump and arranged such that reciprocal motion of the lever means provided by the action of a single hand, unassisted, operates the pump and produces a desired force on the workpiece; release valve means for releasing the force exerted by the hydraulic fluid in response to a manual actuation produced by the single hand and including a valve stem and seat wherein the force urging seating of the valve stem against the valve seat is smaller than the desired force.

14 Claims, 8 Drawing Figures

SINGLE HAND OPERATED TOOL

FIELD OF THE INVENTION

The present invention relates to hydraulic tools which may be held, operated and released with a single hand, unassisted.

BACKGROUND OF THE INVENTION

Various types of hydraulic tools such as wrenches or pliers which may be held in one hand are known. The vast majority of these, however, require both hands of an operator to effect tool engagement or disengagement with the workpiece.

U.S. Pat. No. 3,058,214 of the present inventor shows a one-hand hydraulic tool comprising a frame and a stationary jaw fixed thereto; a movable jaw pivotally mounted in the frame for movement towards and away from the stationary jaw and including a cam member; a hydraulic power system disposed in the frame and including a liquid tank, a piston reciprocable in a cylinder and adapted to be pressed unconnectedly against the cam member of the movable jaw, thereby to impart a moment to the movable jaw, a pump connected to the tank by a suction duct and to the cylinder by a delivery duct, check valves in the suction and delivery ducts, a return duct from the cylinder to the tank, and a pressure release valve in the frame member for the operation of the tool; springy means acting on the movable jaw in opposition to the moment imparted to the movable jaw by the pressure exerted on the cam member by the hydraulic piston; and non-hydraulic means for mechanically imparting to the movable jaw a moment co-directional with the moment imparted to the movable jaw by the piston.

SUMMARY OF THE INVENTION

The present invention comprises a further improvement and refinement of the apparatus described in the aforesaid U.S. patent and provides apparatus having enhanced ease of disengagement. There is thus provided in accordance with an embodiment of the invention a single-hand operated tool comprising:

- first and second relatively movable elements adapted to be associated with a head assembly for application of pressure to a workpiece;
- a housing;
- a hydraulic pump disposed within said housing;
- hydraulic fluid communication means associated with said pump for exerting hydraulic force on said relatively movable elements;
- articulated lever means associated with said pump and arranged such that reciprocal motion of said lever means provided by the action of a single hand, unassisted, operates said pump and produces a desired force on said workpiece;
- release valve means for releasing the force exerted by said hydraulic fluid in response to a manual actuation produced by said single hand and including a valve stem and seat wherein the force urging seating of the valve stem against the valve seat is smaller than said desired force.

Additionally in accordance with an embodiment of the invention there is provided interchangeable hand held tool apparatus as described above wherein the first and second relatively movable members are coaxially disposed for engagement with an interchangeable head assembly and operation thereof.

BRIEF DESCRIPTION OF THE DRAWINGS

The invention will be more fully understood and appreciated from the following detailed description taken in conjunction with the drawings in which.

DETAILED DESCRIPTION OF THE INVENTION

Figure 2:
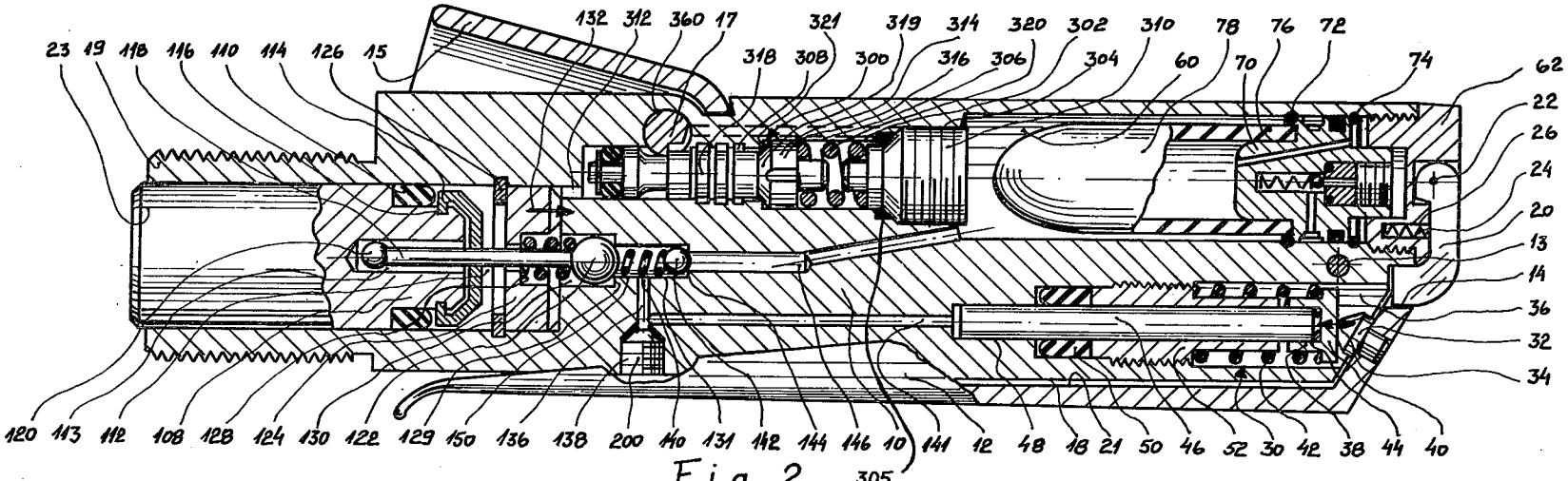
FIG. 2 is a sectional side view illustration of the hand tool of FIG. 1.
Figure 1:
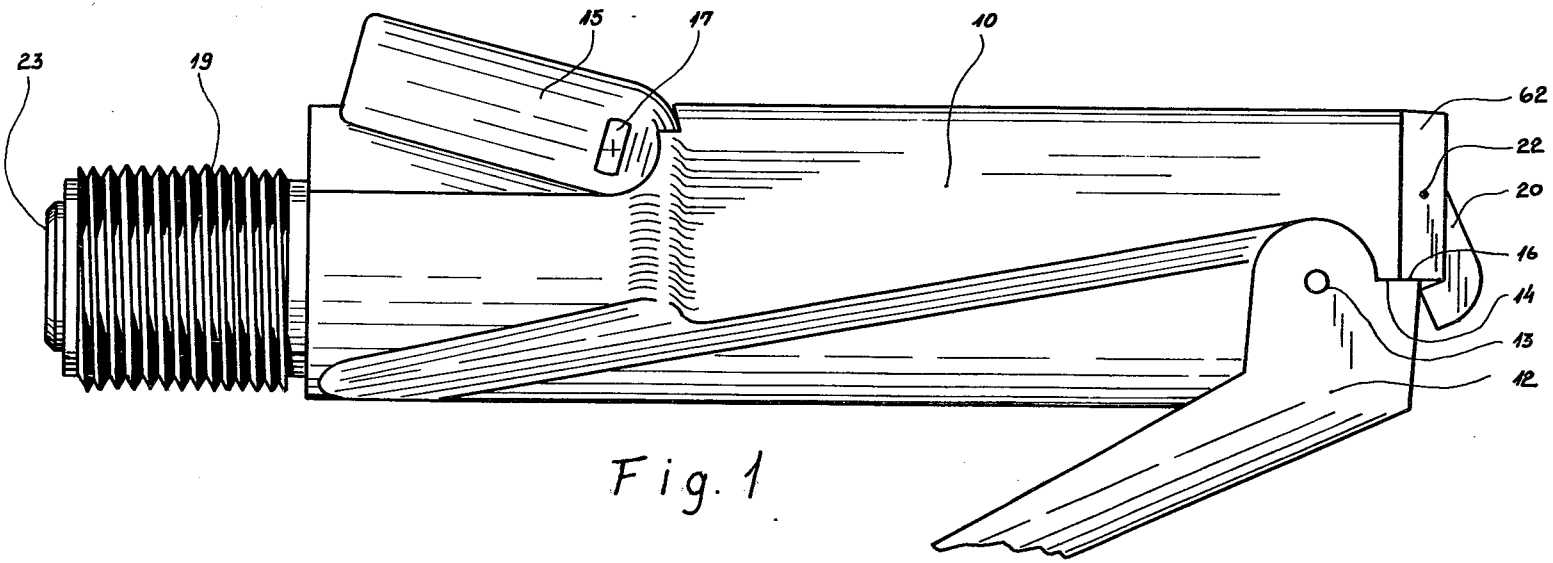
FIG. 1 is a pictorial side view of illustration of a hand held tool constructed and operative in accordance with an embodiment of the invention.

Referring now to FIGS. 1 and 2, there is seen a single-hand held tool comprising a housing 10 generally formed of a unitary block of metal such as steel, hardened so as to be able to withstand the forces generated during tool operation. A lever 12 is pivotably attached onto housing 10 at a pivot axis 13 fixed in the housing and located so as to permit relative reciprocal motion between lever 12 and housing 10 about axis 13. Lever 12 and housing 10 are configured to provide respective confronting surfaces 14 and 16 which define the limit of outward travel of lever 12 with respect to housing 10. The limit of inward travel of lever 12 is defined by confronting surfaces 18 and 21 respectively of housing 10 and lever 12.

It is appreciated that the exemplary embodiment of FIGS. 1 and 2 is illustrated at approximately one and one half times actual size; thus the length of lever 12 and the maximum outward disposition thereof are accommodated to single hand operation of the device.

Lever 12 drivingly engages a hydraulic pump assembly indicated generally by reference numeral 30 via a contact knob 32 which moves during reciprocal motion of lever 12 along a path indicated generally by arrows 34.

Pump assembly 30 is disposed within a suitably configured recess 36 formed, as by boring, in housing 10 and comprises a pump head 38 adapted to be engaged by contact knob 32 formed with a flange 40 to serve as a seat for a return spring 42. Head 38 is also configured to have a central recess 44 arranged to accommodate a pump shaft 46 which is fixedly mounted with respect thereto. Pump shaft 46 is driven for reciprocal motion in a complementarily configured recess 48 and through a center recess defined in a hydraulic fluid seal 50 which is in turn maintained in a desired location by a centrally bored bushing 52. Bushing 52 is threadably engaged with a similarly threaded portion of recess 36 and also serves as a fixed support bulkhead for spring 42.

Lever 12 may be maintained in a closed position with respect to the housing by means of a rotatable locking member 20 which is pivotably mounted on an axis 22 defined within a cap member 62 (to be described hereinafter) for selectable engagement with surface 14.

A spring 24 located in a recess 26 formed in cap member 62 urges member 20 outwardly and out of engagement with surface 14. Such outward travel, however, is permitted only when lever 12 is manually pushed fully into its inward lying position thus bringing surface 14 out of engagement with member 20.

Locking catch member 20 is thus insertable between surfaces 14 and 16 upon lever 12 being disposed fully inwardly against housing 10. The subsequent release of lever 12 when catch member is located between surfaces 14 and 16 is operative to lock the catch member in place as the result of the force of return spring 42 of pump assembly 30 which acts on the lever via pump head 38 and contact knob 32.

A lever 15 is rotatably mounted onto housing 10 for rotation about pivot axis 17. Lever 15 is operative for pressure release as will be described hereinafter.

The relative location of levers 12 and 15 is selected to enable complete operation of the tool with one hand of which four fingers engage lever 12 for pumping and the thumb engages lever 15 for pressure release.

First and second relatively movably concentric elements, typically a cylindrical housing 19 and a piston 23 as illustrated are located at an extreme end of housing 10 and serve as the working members of the tool to which various operating heads may be attached for various specific purposes. It is appreciated that various types of alternative relatively movable working elements may be provided, for example, non-concentric or non-threaded relatively movable elements may alternatively be employed.

Figure 3:
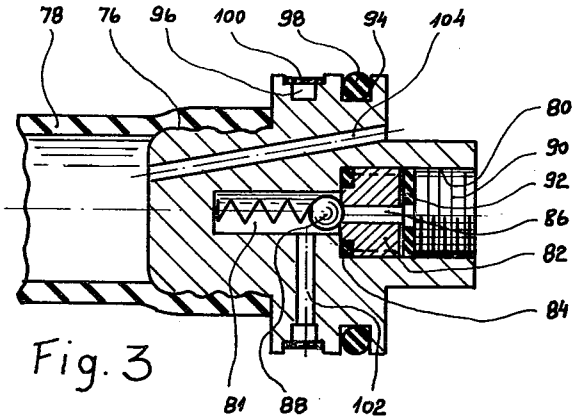
FIG. 3 is a detailed sectional illustration of hydraulic fluid filling apparatus employed in the embodiment of FIGS. 1 and 2.

Reference is now made additionally to FIG. 3 which shows details of a hydraulic fluid filling assembly which may be usefully incorporated in a single hand held hydraulic tool in accordance with an embodiment of the invention.

A fluid filling assembly 70 comprises a neck portion 76 onto which is fitted in hermetic sealing relationship an elastic bladder 78. Assembly 70 is located at a predetermined position in a hydraulic fluid chamber 60 by means of first and second lock rings 72 and 74. Chamber 60 is closed by a cap-member 62 which threadably engages housing 10 without providing a hermetic seal.

Located in a central threaded bore 80 formed in the outer facing end of neck portion 76 is a threaded plug 82 formed with a peripheral end seal 84 and having an axial passageway 86 extending therethrough. Exit of fluid from an interior bore 81 being a smaller diameter continuation of bore 80, through passageway 86 is prevented by a spring loaded ball valve assembly 88 mounted inwardly of plug 82 in bore 81 and seating thereon. A second threaded plug 90 maintains an axially apertured seal 92 in engagement with plug 82 and securely seals bore 80.

Neck portion 76 is formed with first and second peripheral grooves 94 and 96. Located in groove 94 is a peripheral ring seal 98 and located in groove 96 is a filter screen 100. Groove 96 communicates with interior bore 81 via a radial bore 102. A duct 104, communicating between the interior of bladder 78 and the outside is also provided for permitting air from the interior of bladder 78 to escape.

The operation of hydraulic fluid filling assembly 70 will now be briefly summarized.

For filling the apparatus with hydraulic fluid, cap member 62 is threadably disengaged from housing 10 and plug 90 is also threadably removed.

For filling the tool with hydraulic fluid a low pressure hydraulic fluid pump is threadably engaged in bore 80. The tool is oriented such that a venting plug 200 (FIG. 2), to be described hereinafter, is oriented facing upward. This venting plug is slightly opened to allow escape of air therethrough during filling. Pumping of the low pressure pump is commenced and continued until fluid appears at plug 200 at which point the plug is tightly closed. Pumping is once again resumed until bladder 78 is fully collapsed as indicated by increased resistance to further pumping. It is noted that the art previously contained within the bladder 78 escapes via duct 104.

It is to be noted that during this filling operation the operating piston 23 is fully contracted.

The low pressure pump is then decoupled from the threaded bore 80 and plug 90 and cap 62 are replaced. It is appreciated that fluid cannot escape through bore 80 due to the operation of spring loaded ball assembly 88. Bladder 78 serves to maintain the hydraulic fluid pressure within storage chamber 60 at a predetermined relatively low pressure, notwithstanding fluid depletion within given limits.

The apparatus driving power piston 23 will now be described.

Power piston 23 moves axially with respect to coaxial threaded cylinder 19. Piston 23 is preferably formed with a lower diameter portion 108 about which is located a high pressure seal 110, typically formed of Neoprene rubber and which lies in sealing engagement between piston 23 and the interior surface of cylinder 19 which defines a pressure chamber 112.

Figure 8:
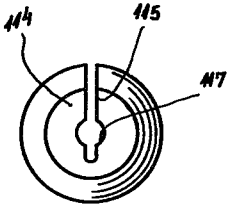
FIG. 8 shows a spring washer member employed in the embodiment of FIGS. 1 and 2.

Seal 110 is retained in position by a spring washer 114 which engages a peripheral groove 116 formed in small diameter portion 108 of piston 23. Spring washer member 114 illustrated in FIG. 8 is suitably configured to have a slit 115 communicating with a central aperture 117, aperture 117 is configured to slidingly accommodate a connecting rod 118.

Disposed within an axial recess 113 formed within piston 23 is one end of connecting rod 118 formed with first and second spherical end members 120 and 122 respectively. The smaller of the spherical members 120, having a diameter greater than that of rod 118 and than that of the corresponding aperture 117 on spring washer 114, is inserted within recess 113. Thus spherical member 120 cannot pass through aperture 117 and the outward displacement of piston 23 is thus limited in a manner which will be described hereinafter.

A spring support seat 124 is fixedly mounted in chamber 112 by means of a lock ring 126 fixedly disposed within chamber 112 at a predetermined position. A compression spring 128 is located peripherally of connecting rod 118 within a recess 130 defined in spring support 124 and in the confronting surface of housing 10. Compression spring 128 urges connecting rod 118 in a direction indicated by arrow 132, i.e. against the extension of piston 23.

Spherical member 122 serves two purposes, the first as a spring mounting surface and the second as a valve which seats against a shoulder 129 defined by the opening of a recess 131 formed in housing 10 and communicating with recess 130.

The pressure exerted by spring 128 urges spherical member 122 into sealing engagement in association with shoulder 129 thereby enhancing seating of member 122 irrespective of tool orientation.

Located within recess 131 is a second compression spring 140 associated with a spherical member 142 located adjacent the entrance 144 to conduit 146 communicating with chamber 60. The valve comprising spring 140, spherical element 142 and the valve seat defined at entrance 144 defines a suction valve 150 whose operation will be described hereinafter.

Recess 131 also communicates via a passage 136 with a vent which is sealed by a plug 200. Vents 138 and recess 131 also communicate via a conduit 141 with recess 48 of pump assembly 30 for receipt of pressurized hydraulic fluid therefrom. Conduit 141 is so configured to define a volume sufficiently large such that hydraulic pressure above a predetermined limit cannot be attained due to the compressability of the hydraulic fluid therein and in the remainder of the hydraulic fluid communication means.

The operation of the hydraulic system for exerting pressure on piston 23 and causing outward travel thereof relative to cylinder 19 will now be briefly summarized.

It is assumed that the hydraulic system is completely filled with fluid by operation of the filling assembly described hereinabove or by any other suitable means. The hydraulic fluid is additionally assumed to be under slight pressure due to the resiliency of bladder 78.

Operation is commenced when the operator grasps housing 10 and lever 12 and presses lever 12 towards housing 10, thereby releasing catch member 20.

Once catch member 20 is released, the force exerted by spring 42 of pump assembly 30 pushes lever 12 outwardly into an angular disposition determined by the orientation of respective bulkheads 14 and 16. Together with lever 12, pump head 38 and shaft 46, fixedly attached thereto, are also drawn to a fully retracted position. Retraction of shaft 46 causes hydraulic fluid to be drawn from fluid storage chamber 60 via conduits 141, 136 and 146 and recess 131. It is appreciated that the suction thus exerted on spherical member 142 against the urging of spring 140 unseats suction valve 150 sufficiently to permit the indicated fluid flow.

The manual application of force on lever 12 urging it towards housing 10 causes forward motion of pump shaft 46 which forces fluid back through conduit 141 to recess 131. Since the fluid is prevented from exiting to conduit 146 by valve assembly 150, it causes the temporary unseating of spherical member 122 from its seat 129 during the pressure portion of the pumping cycle, thereby supplementing hydraulic fluid in recess 112 and forcing piston 23 outwardly with respect to member 19.

Repeated reciprocal motion of lever 12 with respect to housing 10 causes further forward displacement of the piston. Continued operation of the pump and displacement of the piston to a predetermined limit defined by the length of rod 118, causes spring washer 114 to engage spherical member 120 and to pull it, together with rod 118, fixedly attached thereto, in the forward direction. This in turn causes spherical member 122, also fixedly attached to rod 118, to become unseated permanently. In this condition, in contrast to the operation of the device before such a condition is obtained, spherical element 122 does not seat during the suction portion of the pumping cycle and thus fluid pumped thereinto is removed therefrom without inhibition as pump shaft 46 is actuated. As a result piston 23 oscillates axially during successive pressure and suction portions of the pumping cycle as the lever continues to be operated in the limit condition since continuous communication is provided between the fluid at the pump and that in recess 112.

The release of pressure on piston 23 is accomplished by the operation of a release valve assembly 300 which will now be described.

The release valve assembly 300 is disposed within a recess 302 which may conveniently be formed by boring in housing 10 as an extension of fluid chamber 60. Recess 302 is formed of first, second and third sections 304, 306 and 308 of differing diameters arranged such that section 304, lying adjacent to chamber 60, has the largest diameter while intermediate section 306 has the next largest diameter and forward-most section 308 has the smallest diameter. A plug 310 which threadably engages section 304 and a seal 305 provide a high pressure seal between chamber 60 and the remainder of recess 300, thereby providing a total separation between the valve assembly and fluid chamber 60.

Portion 308 of recess 300 communicates with pressure chamber 112 via a conduit 312. The movable member 314 of valve assembly 300 is a shaft configured to define first and second sections 316 and 318. Section 316 has a larger diameter than section 318 and section 316 moves in section 306 of the recess 302 while section 318 moves mainly in section 308 of the recess. A compression spring 320 is disposed between plug 310 and section 316 of moving member 314 for urging member 314 forwardly into recess section 308.

Sections 316 and 318 are joined by a tapered portion 319 which seats against a shoulder 321 defined by adjacent sections 306 and 308 of recess 302. Thus urging of spring 320, in the absence of countervailing forces, causes tapered portion 319 to sealingly seat against shoulder 321.

Figure 5:
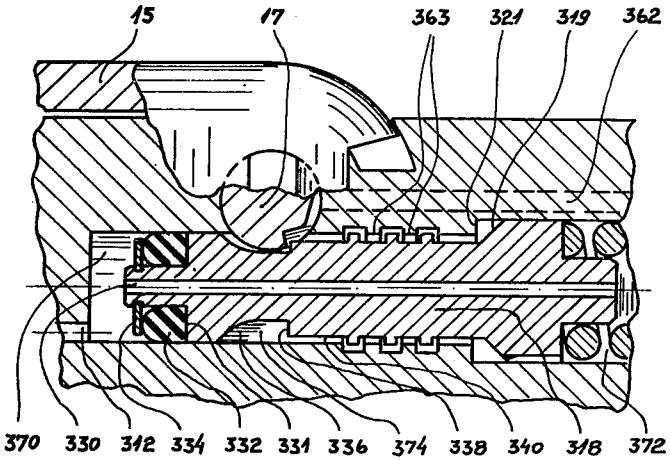
FIG. 5 is a detailed illustration of the release valve of FIG. 4 arranged in an open position.
Figure 4:
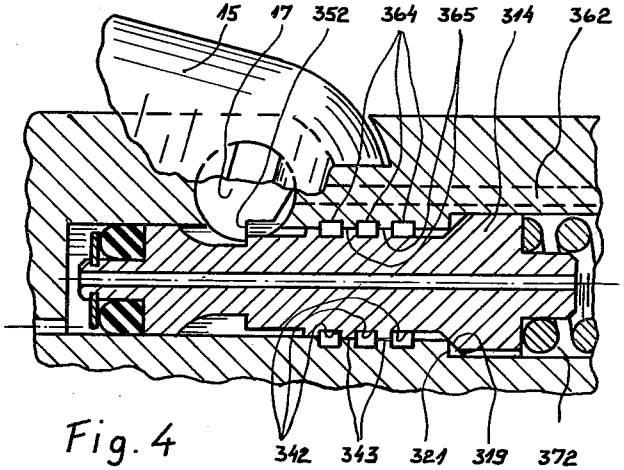
FIG. 4 is a detailed illustration of the release valve incorporated in the embodiment of FIGS. 1 and 2 arranged in a closed position.

Referring now additionally to FIGS. 4 and 5, the detailed configuration of movable member 314 will now be considered. Large diameter portion 316 and small diameter portion 318 form a unitary element having an axial bore 330 extending therethrough. At the extreme inward end of portion 318 in a recess 331, there is provided a high pressure seal 332 retained in position with respect to portion 318 by a retaining ring 334.

Adjacent seal 332 there is defined a tapered angular recess 336 which terminates in a shoulder 338 and communicates with a shallow recess 340. Intermediate shallow recess 340 and tapered portion 319 there are formed a number of relatively spaced uniform annular recesses 342 separated from each other and from recess 340 by separation 343. The width of recesses 342 along the longitudinal axis of member 314 exceeds the width of the separation therebetween and exceeds the width of the separation between shallow recess 340 and the adjacent recess 342.

Figure 6:
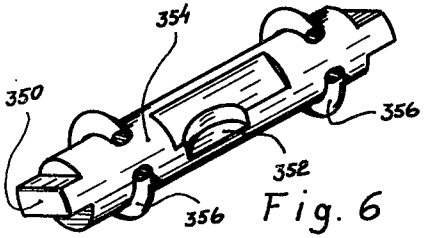
FIG. 6 is a pictorial illustration of a pivot member forming part of the release valve of FIGS. 4 and 5.

Reference is now made additionally to FIG. 6 which shows a pivot member 350 formed with an interior notch 352 which engages shoulder 338 and exterior protrusions which engage lever 15. Pivot member 350 comprises a generally cylindrical body 354 surrounded at opposite ends by peripheral low pressure ring seals 356 so as to prevent the leakage of hydraulic fluid from the vicinity of the center of body 354 to the outside of the tool. Pivot 350 is located in a recess 360 formed in housing 10, the interior of which is in communication with fluid chamber 60 via a bore 362.

Pivot 350 is coupled to lever 15 such that depression of lever 15 causes rotation of pivot 350 about axis 17 with the consequence that notch 352 which engages shoulder 338 is pushed in a direction opposing the force exerted by spring 320.

Portion 308 of recess 300 is configured to have a plurality of spaced peripheral angular recesses 364 and separation 363 formed therein of width and spacing substantially identical to that of recesses 342 and separations 343 formed in member 314. Recesses 364 are positioned such that the recesses and separations are aligned thus defining common mating surfaces 365 which thus produce resistance to fluid flow, when tapered portion 319 is in spring-urged engagement with shoulder 321 and lever 15 is in its unactuated position. It is appreciated that the outer diameter of portion 318 and inner diameter of portion 308 must be fabricated to relatively high tolerances such as 5–10 microns in order to provide the desired resistance to fluid flow.

FIG. 4 shows relative orientation of member 314 in recess 300 when pressure release lever 15 is not depressed and respective recesses 342 and 364 are in alignment. In such an orientation three chambers are defined. The first, indicated by reference numeral 370, lies beyond high pressure seal 332 and in fluid communication with chamber 112 which is under high pressure when piston 23 is extended. The second, indicated by reference numeral 372, lies within recess portion 306 and is also maintained at high pressure due to the fluid communication afforded through bore 330, providing pressure equalisation between chambers 370 and 372. The third chamber 374 is located at recesses 336 and 340 and communicates via bore 362 with fluid chamber 60. When the apparatus is oriented as shown in FIG. 4, no fluid communication between chamber 374 and either of chambers 370 and 372 exists.

It is the function of release valve assembly 300 to release relatively high hydraulic pressure built up behind piston 23 at a time and at a rate controllable by an operator with the action of a single hand, unassisted.

It is appreciated that the provision of fluid communication bore 330 effectively balances the axial forces acting on element 314 such that the net axial force acting thereon is that exerted by spring 320 urging tapered portion 319 against shoulder 321.

It has been found in practice that a slight increase in the effective diameter of the contact seal at shoulder 321 which occurs during use gives rise to additional small forces codirectional with the axial force exerted by spring 320 which further improves sealing action.

The depression of lever 15 causes pivot 350 to rotate thereby pushing member 314 against the force exerted by spring 320. As a result, tapered portion 319 is unseated from shoulder 321 permitting fluid to leak from pressure chamber 372 to chamber 374 at a rate governed by the resistance to fluid flow of the groove system. If lever 15 is only slightly depressed, grooves 364 and 342 are virtually aligned and the fluid must leak through mating surfaces 365. If a faster release is required by the operator, lever 15 is further depressed thereby diminishing the extent of the mating surfaces and thus decreasing resistance to fluid flow. If lever 15 is fully depressed, grooves are completely non-aligned and fluid can flow virtually without resistance.

As noted earlier, chamber 374 is in fluid communication with fluid chamber 60 permitting drainage of hydraulic fluid thereto and release of pressure behind piston 23.

It is appreciated that the amounts of hydraulic fluid employed in the tool described hereinabove are relatively small and thus the system has the characteristics of a hydrostatic system rather than a hydrodynamic one. As a result in conventional hydraulic tools, release of pressure produces a jolt.

The particular construction of release valve described hereinabove in which the relatively high pressure exerted on the valve is in effect cancelled out enables the valve to be operated with the exertion of relatively little force, permitting one hand operation of the tool. At the same time, the operator is provided with full control over the rate of pressure release and can terminate pressure release at any intermediate stage. As a result the jolt which is characteristic of prior art hydraulic tools need not be present in the embodiment described. Furthermore the sharp and sudden release of pressure produced in prior art mechanisms is obviated.

Figure 7:
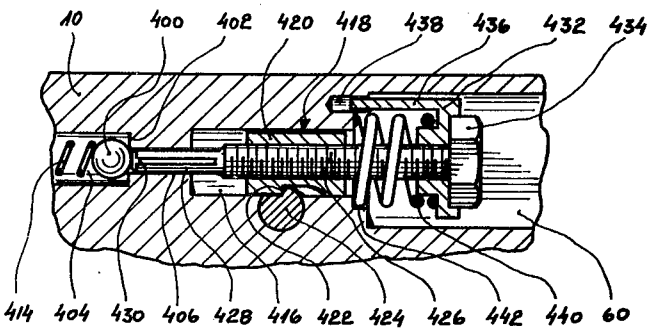
FIG. 7 is a sectional side view illustration of an alternative embodiment of a release valve for a single hand held tool constructed and operative in accordance with an embodiment of the invention.

Reference is now made to FIG. 7 which shows an improved release valve especially adapted for use in association with a single-hand held tool cutting mechanism. The remainder of the tool is substantially the same or analogous to the single-hand operated tools described hereinabove and will not be particularly described herein.

The release valve comprises a ball 400 which seats against a shoulder 402 defined within housing 10 between a recess 404 and a channel 406.

Recess 404 communicates with a pressure chamber (not shown) associated with a movable piston (not shown). A compression spring 414 disposed within recess 404 urges ball 400 into a seating orientation against shoulder 402 A recess 416, typically formed by boring as a continuation of fluid chamber 60 is in fluid communication, via channel 406, with recess 404. Disposed within recess 416 is a valve ball dislodgement mechanism indicated generally by reference numeral 418 and comprising a bushing 420 formed with a notch 422 which is engaged by a notched pivot member 424 which is similar in all relevant respects to the pivot member illustrated in FIG. 6. Pivot member 424 is coupled to a release lever (not shown).

A threaded dislodgement shaft 426 threadably engages bushing 420 through a threaded bore formed therein and comprises a forward fluted portion 428 which travels within channel 406 and whose tip 430 selectably engages ball 400 for dislodgement thereof from shoulder 402 thus opening the valve defined thereby and permitting the flow of hydraulic fluid from the pressure cylinder into fluid chamber 60 via conduit 406 and recesses 404 and 416.

In the past considerable expense was involved in machining rod 426 to precise tolerances so as to insure that (1) in a rest position tip 430 did not dislodge the ball 400, and (2) that an undue amount of forward travel was not required to dislodge ball 400 as desired. This problem and the accompanying problem of accuracy due to wear are overcome herein by making the axial position of tip 430 with respect to the pivot point of pivot 424 selectable by selectable threading of rods 426 and bushing 420.

Inadvertent rotation of rod 426 is prevented by a lock washer 432 which engages the head 434 of rod 426 so as to prevent relative rotation between washer 432 and head 434. Bushing 420 cannot rotate due to the interlocking relationship thereof with pivot 424. Washer 432 also includes an arm 436 which seats in a recess 438 formed in housing 10 thus preventing rotation of the lock washer relative to the housing. The lock washer is maintained in engagement with head 434 by means of a compression spring 440 which seats in an angular recess 442 formed in housing 10 and against lockwasher 432. Spring 440 operates to return the release valve assembly to its sealed position.

It may thus be appreciated that initial adjustment of the position of rod 426 is such that when the pressure release lever (not shown) is not engaged, tip 430 or rod 426 touches or nearly touches ball 400 but does not dislodge it. However, it is sufficiently close so as to minimize the forward travel of tip 430 required for dislodging ball 400 and thus opening the valve and releasing the pressure in recess 404.

It will be appreciated by persons skilled in the art that the embodiments of the invention described hereinabove are merely exemplary of the wide range of hand held tools which lie within the scope of the invention. Therefore the invention is not limited by the examples shown and described hereinabove and is defined only by the claims which follow:

I claim:

1. A single-hand operated tool comprising:

first and second relatively movable elements adapted to be associated with a head assembly for application of pressure to a workpiece;

a housing;

a hydraulic pump disposed within said housing;

hydraulic fluid communication means associated with said pump for exerting hydraulic force on said relatively movable elements;

articulted lever means associated with said pump and arranged such that reciprocal motion of said lever means provided by the action of a single hand, unassisted, operates said pump and produces a desired force on said workpiece;

release valve means for releasing the force exerted by said hydraulic fluid in response to a manual actuation produced by said single hand and including a valve stem and seat wherein the force urging seating of the valve stem against the valve seat is smaller than said desired force.

2. A single-hand operated tool according to claim 1 wherein said release valve means is operable for releasing the pressure exerted by said hydraulic fluid at a selectable rate in response to a manual actuation.

3. A single-hand operated tool according to claim 1, wherein said release valve means comprises means for supplying hydraulic fluid to opposite ends of said valve stem.

4. A single-hand operated tool according to claim 1, wherein said pressure release valve means comprise pressure reducing means disposed along a hydraulic fluid flow path defined from said hydraulic communication means under said desired pressure, to a low pressure location when said valve stem is unseated from said valve seat.

5. A single-hand operated tool according to claim 1, wherein said first and second relatively movable elements comprise a piston arranged to move relative to an element fixed with respect to said housing.

6. A single-hand operated tool according to claim 5, and wherein said hydraulic communication means comprises a pressure chamber located adjacent to said piston whereby a build-up of hydraulic pressure therein causes displacement of said piston relative to said fixed element.

7. A single-hand operated tool according to claim 1 and also comprising limiting means for preventing relative travel of said first and second relatively movable elements beyond a predetermined limit.

8. A single-hand operated tool according to claim 7, wherein said limiting means comprises a valve associated with said hydraulic fluid communication means and mechanically coupled to at least one of said first and second relatively movable elements and arranged such that when said first and second relatively movable elements attain relaive displacement exceeding a predetermined limit, said valve is maintained in a condition which prevents a further build-up of hydraulic pressure on said workpiece.

9. A single-hand operated tool according to claim 1 and also comprising means for filling said hydraulic tool with a hydraulic fluid under relatively low pressure and including:

means for preventing back flow of said hydraulic fluid from the tool before, during and after the filling operation;

hydraulic fluid reservoir means; and resilient bladder means associated with said reservoir for maintaining said hydraulic fluid under a predetermined relatively low pressure notwithstanding depletion of said fluids in said reservoir.

10. A single-hand operated tool according to claim 1 and also comprising a hydraulic fluid reservoir associated with said hydraulic fluid communication means and dimensioned such that pressure above a predetermined limit cannot be obtained therein due to the known compressibility of the hydraulic fluid.

11. A hand operated tool comprising:

first and second relatively movable elements adapted to be associated with a head assembly for application of pressure to a workpiece;

a housing;

a hydraulic pump disposed within said housing;

hydraulic fluid communication means in association with said pump for exerting hydraulic pressure on said relatively movable elements;

pressure release valve means for releasing the pressure exerted by said hydraulic fluid and including:

a valve seat;

a member sealingly seatable in said valve seat;

spring means urging said sealingly seatable member into sealing seating engagement with said valve seat;

means for selectably unseating said seatable member from said valve seat by contacting said seatable member and pushing it against the urging of said spring away from said seat and including:

lever means adapted to be operated by a human hand;

mounting means arranged in association with said lever means for being driven in longitudinal motion thereby; and pin means selectably positionable with respect to said mounting means for precisely determining the separation between said mounting means and said seatable member during seating orientation of said seatable member.

12. Release valve means for use with a high pressure fluid system and comprising a valve stem and a housing relative to which said valve stem travels along the longitudinal axis thereof, said housing communicating at a first end thereof with a source of high pressure fluid;

said valve stem and housing being configured to define a communication path for said high pressure fluid from said first end of said housing alongside one end of said stem to a second end of said housing alongside the opposite end of said stem thereby to geneally equalize the high pressure exerted longitudinally of said stem and to minimize the resistance to longitudinal motion of said stem due to said high pressure;

said stem and said housing being configured to define a low pressure volume intermediate said stem and said housing and located intermediate said first and said second ends and to define selective pressure reducing means permitting the flow of said fluid at high pressure to said low pressure volume at a controlled rate determined by the relative positions of said stem and said housing.

13. Apparatus according to claim 12 wherein the selective pressure reducing means comprises a plurality of spaced peripheral grooves formed on said stem and said housing and arranged to be aligned and confronting when said stem is in a seated position and to become disaligned and non-confronting when said stem is not in said seated position, whereby when said stem is in said seated position the separation defined between said grooves provides sealing between said high pressure chambers and said low pressure volume while when said valve becomes unseated the amount of displacement of said stem and said valve seat determines the proportion of said confronting separation surfaces which are in contact and thus the rate at which fluid is permitted to pass therethrough from a high pressure location to a low pressure location.

14. A single-hand operated tool according to claim 1, wherein said pressure release valve means comprises a valve stem and a housing relative to which said valve stem travels along the longitudinal axis thereof, said housing communicating at a first end thereof with a source of high pressure fluid;

said valve stem and housing being configured to define a communication path for said high pressure fluid from said first end of said housing alongside one end of said stem to a second end of said housing alongside the opposite end of said stem thereby to generally equalize the high pressure exerted longitudinally of said stem and to minimize the resistance to longitudinal motion of said stem due to said high pressure;

said stem and said housing being configured to define a low pressure volume intermediate said stem and said housing and located intermediate said first and said second ends and to define selective pressure reducing means permitting the flow of said fluid at high pressure to said low pressure volume at a controlled rate determined by the relative positions of said stem and said housing.

* * * * *